US006464339B1

(12) United States Patent
Ardito

(10) Patent No.: US 6,464,339 B1
(45) Date of Patent: Oct. 15, 2002

(54) FLUID INTERCONNECT PORT SEAL WITH LOCK-OUT TAB

(75) Inventor: Michael S. Ardito, Lebanon, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/004,389

(22) Filed: Oct. 25, 2001

(51) Int. Cl.[7] ..... B41J 2/01
(52) U.S. Cl. ..... 347/49
(58) Field of Search ..... 347/49, 50, 86, 347/85, 87; 428/354

(56) References Cited

U.S. PATENT DOCUMENTS 5,245,361 A * 9/1993 Kashimura et al. ..... 347/50
5,831,652 A * 11/1998 Hinami et al. ..... 347/86
6,164,769 A * 12/2000 Inada et al. ..... 347/86
6,276,786 B1 8/2001 Eida et al. ..... 347/86

* cited by examiner

*Primary Examiner*—Michael Nghiem
(74) *Attorney, Agent, or Firm*—Larry D. Baker

(57) ABSTRACT

Removable fluid port seals for fluid containers that are configured for insertion into a receiving station within a fluid utilizing system are disclosed. An exemplary use of the fluid port seal is to seal replaceable ink containers for use in ink jet printers, although the present invention is not limited to a specific field of application. The fluid port seal has a tab portion which extends beyond the container and interferes with installation of the container into the receiving station if an installer attempts to install the fluid container in the utilizing system without first removing the seal.

16 Claims, 8 Drawing Sheets

FLUID INTERCONNECT PORT SEAL WITH LOCK-OUT TAB

TECHNICAL FIELD OF THE INVENTION

The present invention relates to removable seals for fluid containers. More specifically, exemplary embodiments of the present invention relate to removable fluid port seals for ink containers for an inkjet printing system.

BACKGROUND OF THE INVENTION

Inkjet printers typically use a printhead mounted on a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead. With separately replaceable ink supplies, the ink supply is replaced when exhausted, and the printhead is then replaced at the end of the printhead useful life.

When the ink supply is replaceable separate from the printhead, the supply may be either located on the carriage with the printhead or located remotely from the printhead ("off axis"). Locating the supply on the carriage with the printhead is generally a less expensive approach, although the quantity of ink provided with each replaceable supply is limited by the considerations of the total mass that must be moved on the carriage, and the spatial volume swept by the carriage.

Regardless of where the ink supply is located within the printing system, it is critical that the ink supply provide a reliable supply of ink to the inkjet printhead. In printer systems having separate ink supplies and printheads, the printheads are typically intended to have a much longer useful life than the ink supplies. A common cause of printhead failure is the operation of the printhead without a continuous supply of ink. Replacement of printheads damaged through lack of a reliable ink supply can be costly to the end user.

The fluid ports on replacement ink containers are typically sealed to prevent leakage and spillage. One potential cause of an interrupted ink flow is the installation of a new ink container into the printer system without first removing the fluid port seal. There is thus a need for devices and methods which prevent an end user from installing a replacement ink container into a printer system without first removing the fluid port seal.

SUMMARY OF THE INVENTION

Embodiments of the present invention comprise removable fluid port seals for fluid containers that are configured for insertion into a receiving station within a fluid utilizing system. An exemplary use of the fluid port seal is to seal replaceable ink containers for use in ink jet printers, although the present invention is not limited to a specific field of application. The fluid port seal has a tab portion which extends beyond the container and interferes with installation of the container into the receiving station if an installer attempts to install the fluid container in the utilizing system without first removing the seal.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

Figure 1:
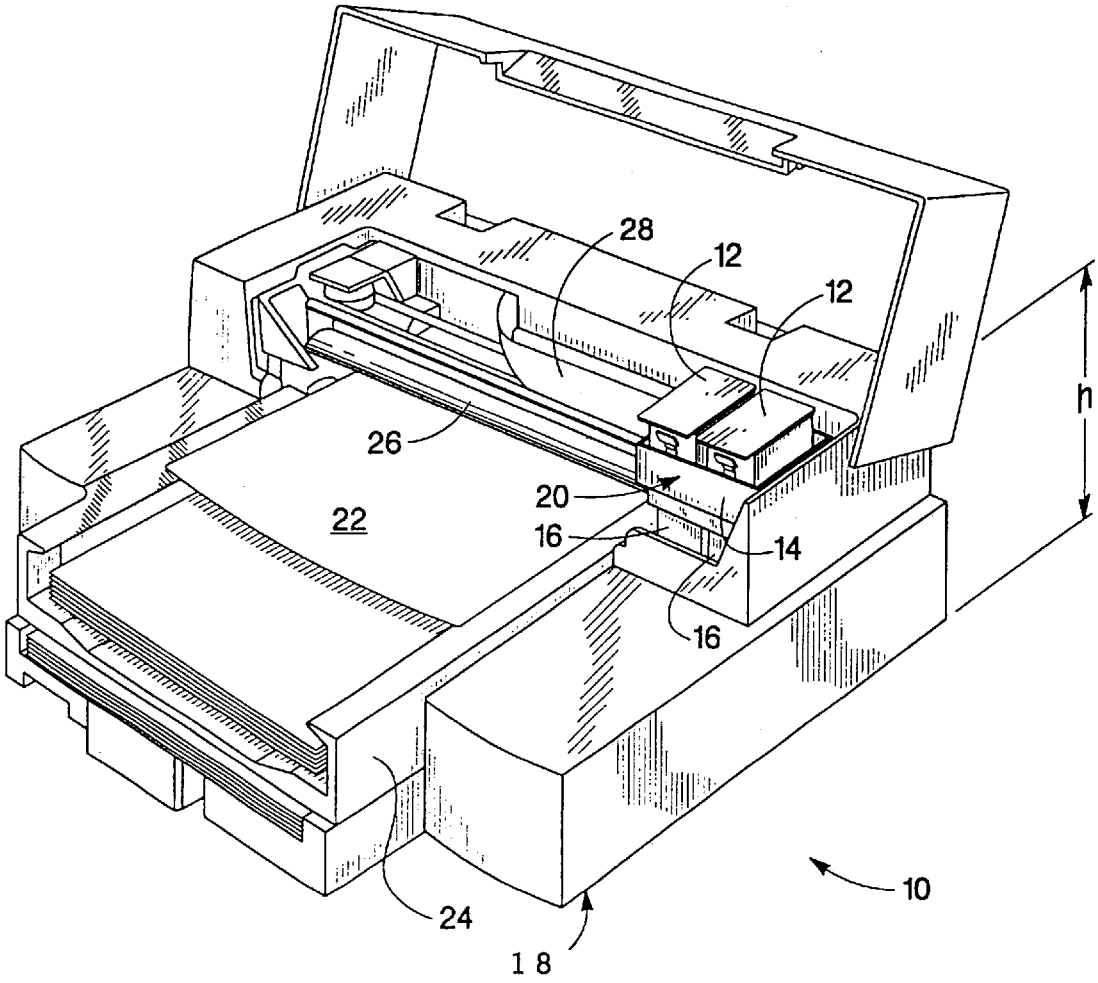
FIG. 1 is one exemplary embodiment of an ink jet printing system, depicted with a cover opened to show a plurality of replaceable ink containers with which the fluid interconnect seal with lock-out tab of the present invention may be utilized.

FIG. 1 is a perspective view of one exemplary embodiment of a printing system 10 shown with its cover open, that includes at least one replaceable ink container 12 installed in a receiving station 14. With the replaceable ink container 12 properly installed into the receiving portion 14, ink is provided from the replaceable ink container 12 to at least one inkjet printhead 16. The inkjet printhead 16 is responsive to activation signals from a printer portion 18 to deposit ink on print media. As ink is ejected from the printhead 16, the printhead 16 is replenished with ink from the ink container 12. In one preferred embodiment, the replaceable ink container 12, receiving station 14, and inkjet printhead 16 are each part of a scanning carriage that is moved relative to a print media 22 to accomplish printing. The printer portion 18 also includes a media tray for receiving the print media 22. As the print media 22 is stepped through a printing zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

It is essential for the proper operation of the printing system that, when an ink container 12 is replaced, both proper fluidic and electrical connection be established between the ink container 12 and the printer portion 18. The fluidic interconnection allows a supply of ink within the replaceable ink container 12 to be fluidically coupled to the printhead 16 for providing a source of ink to the printhead 16. The electrical interconnection allows information to be passed between the replaceable ink container 12 and the printer portion 18. Information passed between the replaceable ink container 12 and the printer portion 18 can include, by way of example, information related to the compatibility of replaceable ink container 12 with printer portion 18 and operation status information such as the ink level information.

New ink containers 12 are provided to the printer user with the fluid port sealed to prevent ink spillage during shipping and storage. It is critical that the fluid port be unsealed prior to installing a new ink container in the printer, since operating the printer without a reliable supply of ink can cause permanent damage of the printheads. The fluid interconnect label lock-out tab of the present invention, as will be discussed with respect to FIGS. 5 through 10, ensures that a new ink container 12 is not installed into the receiving portion 14 with the fluid interconnect seal in place.

Figure 2:
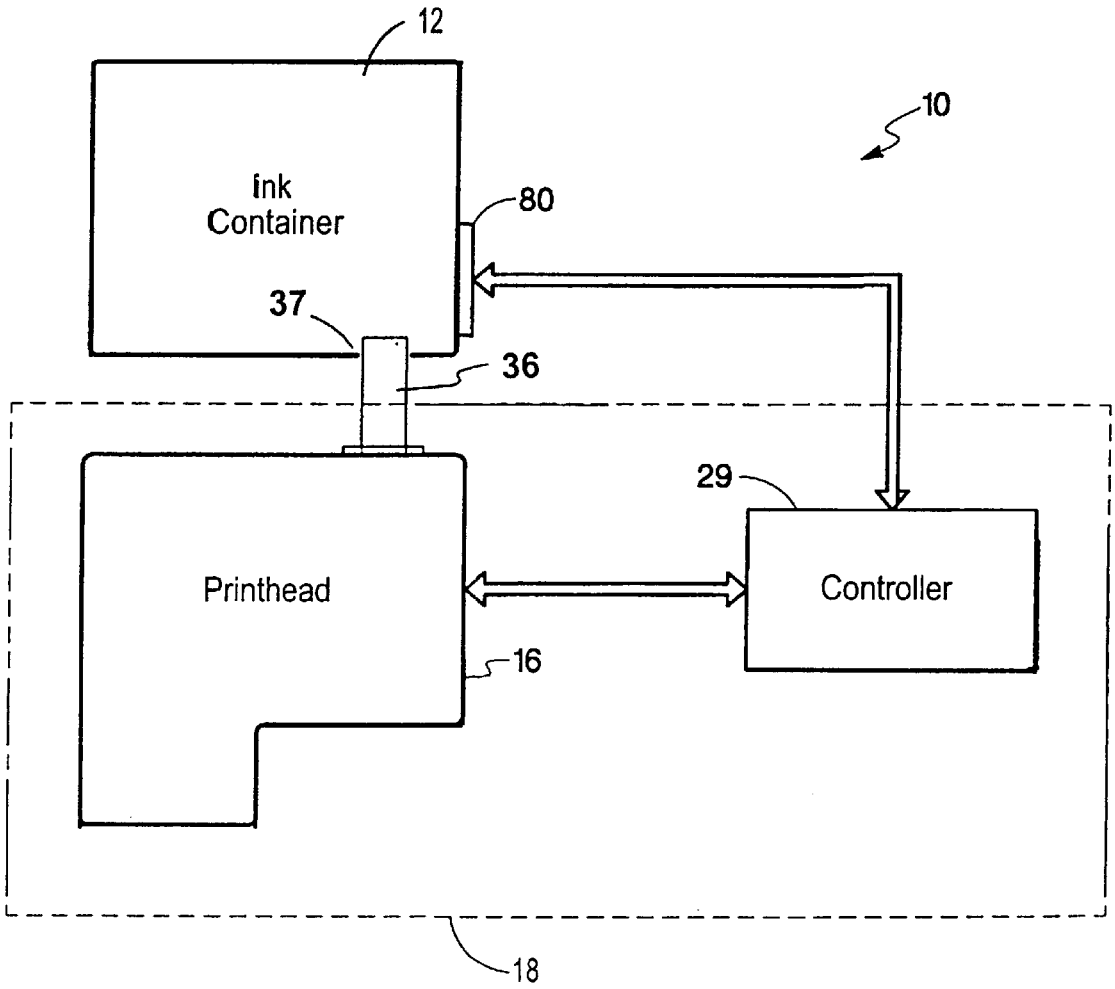
FIG. 2 is a simplified schematic representation of the exemplary inkjet printing system shown in FIG. 1.

FIG. 2 is a simplified schematic representation of the exemplary inkjet printing system 10 shown in FIG. 1. FIG. 2 is simplified to illustrate a single printhead 16 connected to a single ink container 12. The inkjet printing system 10 of the present invention includes the printer portion 18 and the ink container 12, which is configured to be received by the printer portion 18. The printer portion 18 includes the inkjet printhead 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the printhead 16. Upon installation of the ink container, a fluid interconnect 36 engages the fluid port 37 of the ink container, establishing fluid flow. The fluid interconnect 36 may comprise a separate manifold component on the scanning carriage 20, as discussed below. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other functions, controls the transfer of information between the printer portion 18 and the replaceable ink container 12. In addition, the controller 29 controls the transfer of information between the printhead 16 and the controller 29 for activating the printhead to selectively deposit ink on print media, and controls the relative movement of the printhead 16 and print media. The controller 29 performs additional functions such as controlling the transfer of information between the printing system 10 and a host device such as a computer (not shown).

In order to ensure the printing system 10 provides high quality images on print media, the controller 29 may utilize parameters that are provided by the electrical storage device 80 to optimize the printer operation. Among the parameters, for example, that can be stored in the electrical storage device 80 associated with the replaceable ink container 12 are following: a date code associated with the replaceable ink container 12, a date code of initial insertion of the ink container 12, system coefficients, ink type and ink color, ink container size, printer model number or identification number and container usage information, just to name a few.

Figure 3:
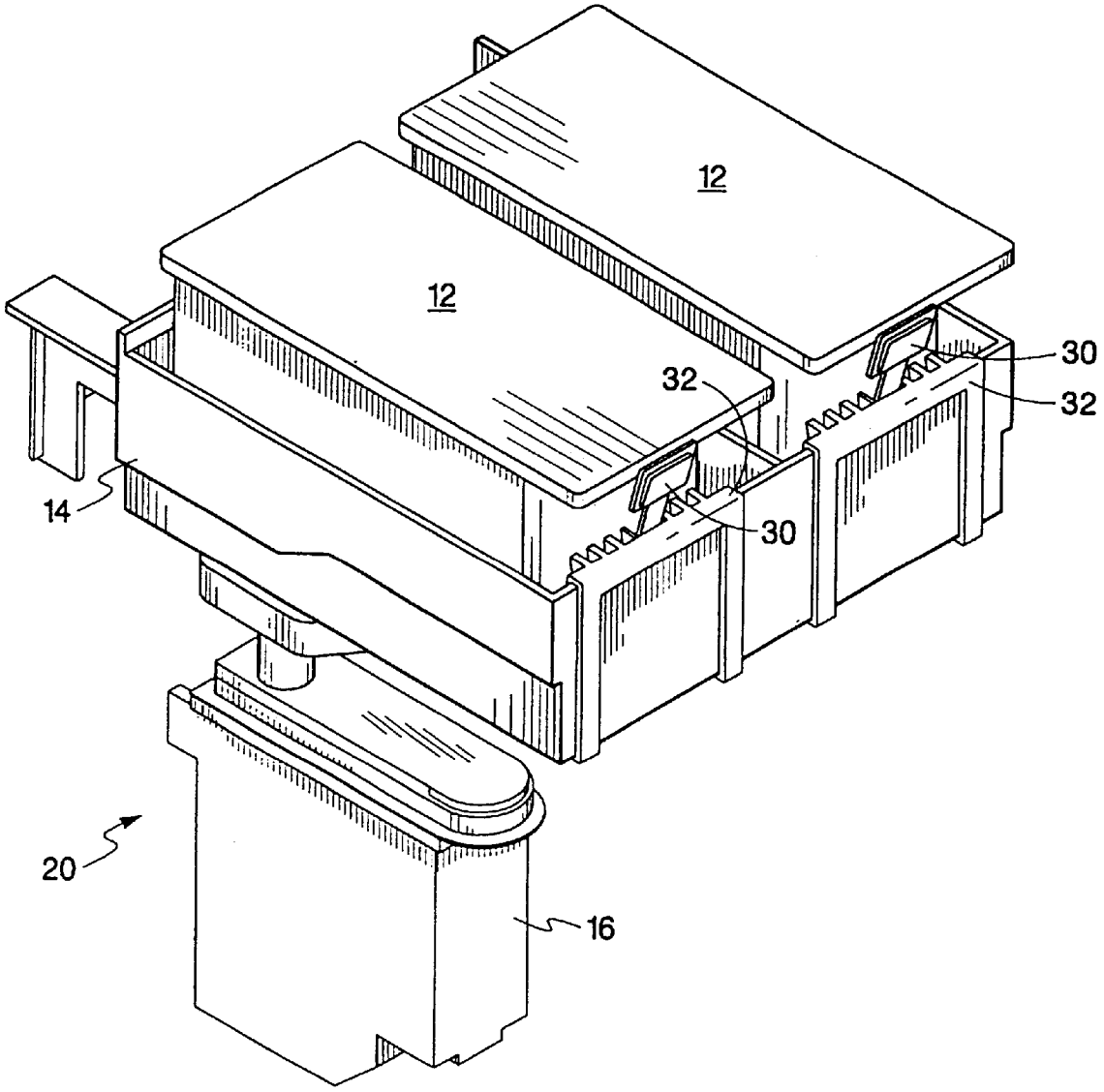
FIG. 3 is a greatly enlarged perspective view of a portion of a scanning carriage showing the replaceable ink containers positioned in a receiving station that provides fluid communication between the replaceable ink containers and one or more printheads.

FIG. 3 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tri-color ink container containing three separate ink colors (cyan, magenta, and yellow) and a second ink container containing black ink. The replaceable ink containers 12 can be partitioned differently to contain fewer than three ink colors or more than three ink colors if more are required. For example, in the case of high fidelity printing, frequently six or more colors are used.

The scanning carriage portion 20 shown in FIG. 3 is shown fluidically coupled to a single printhead 16 for simplicity. In the exemplary embodiment, four inkjet printheads 16 are each fluidically coupled to the receiving station 14. In this embodiment, each of the four printheads are fluidically coupled to each of the four colored inks contained in the replaceable ink containers 12.

Each of the replaceable ink containers 12 include a latch 30 for securing the replaceable ink container 12 to the receiving station 14. The receiving station 14 in the preferred embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 4:
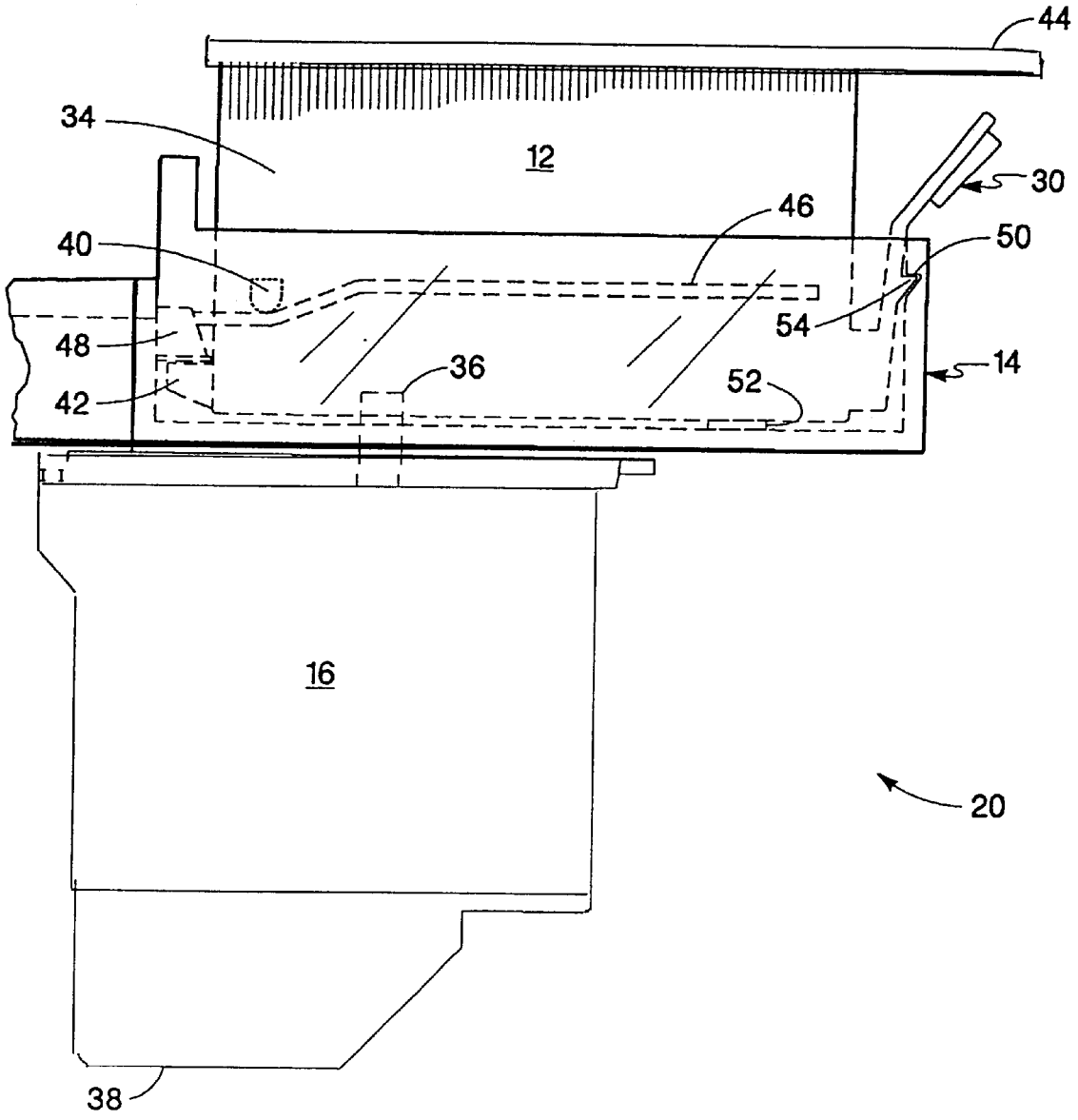
FIG. 4 is a side plan view of a portion of the scanning carriage showing guiding and latching features associated with each of the replaceable ink container and the receiving station for securing the replaceable ink container, thereby allowing fluid communication with the printhead.

FIG. 4 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16. The replaceable ink container 12 includes a reservoir portion 34 for containing one or more quantities of ink. In the exemplary embodiment, the tri-color replaceable ink container 12 has three separate ink containment reservoirs, each containing ink of a different color. The black replaceable ink container 12 is a single ink reservoir 34 for containing black ink. In the exemplary embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10.

This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force resulting from the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 of the exemplary embodiment is preferably an upstanding ink pipe that extends upwardly into the ink container 12 and downwardly to the inkjet printhead 16. The fluid interconnect 36 is shown greatly simplified in FIG. 4. In the exemplary embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20.

The receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14.

Figure 5:
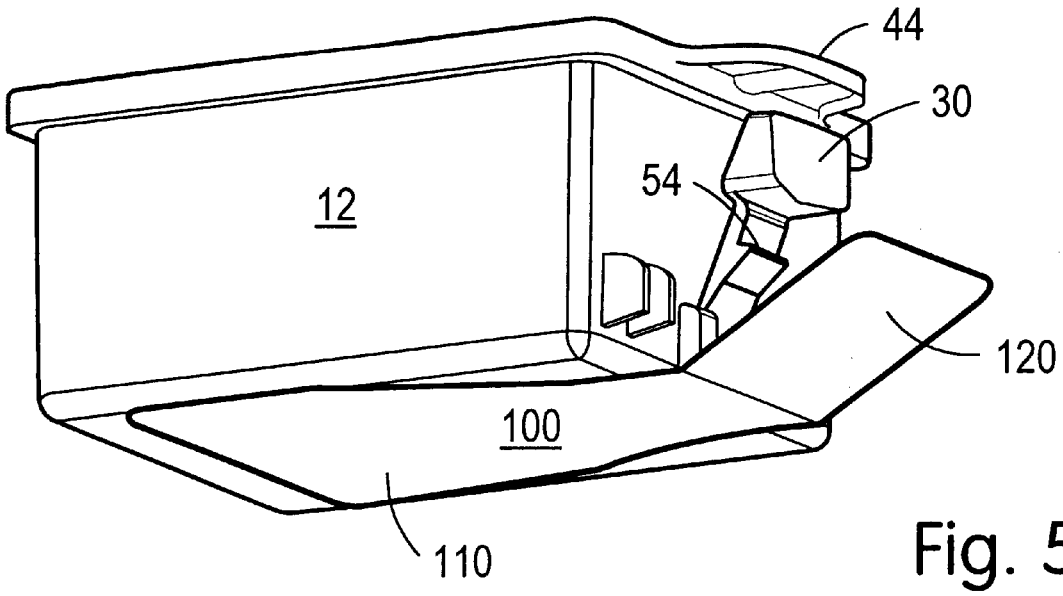
FIG. 5 is a perspective view of an exemplary replaceable ink container with the fluid interconnect seal with lock-out tab of the present invention attached.

FIG. 5 is a perspective view of a replacement ink container including the fluid interconnect seal with lock-out tab 100 of the present invention, as the ink container would appear to the printer user prior to removal of the interconnect seal. The fluid interconnect seal 100 includes a back portion 110 which covers the one or more fluid ports on the ink container, and a tab portion 120 which extends out from the ink container. When installed on the ink container, the tab portion 120 of the seal extends forward of the latch member 30, including hook feature 54, which prevents successful installation of the ink container into the receiving station, as discussed below. The fluid interconnect seal 100 thus prevents a situation where the container is installed in the chute and latched, but no ink is flowing from it to the pens. The fluid interconnect seal 100 preferably includes printed graphics and information on its surface to identify the ink container, provide the printer user with installation instructions, and to warn the user that the seal must be removed before installation of the ink container into the printer. A handle 44 is disposed on a top surface of the replaceable ink container 12. The handle portion 44 allows the ink container 12 to be grasped while inserted into the appropriate bay of the receiving station 14.

Figure 6:
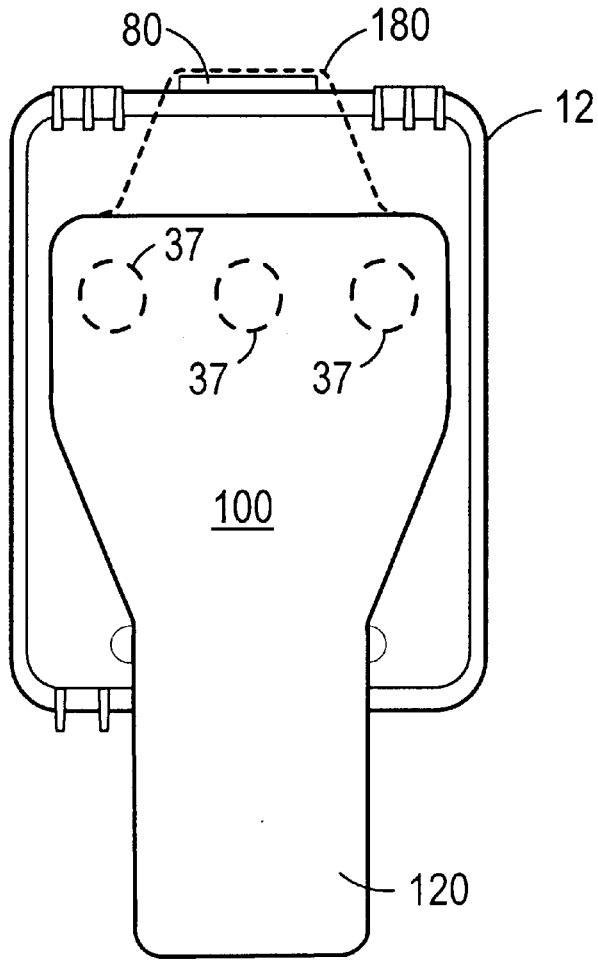
FIG. 6 is a bottom plan view of an exemplary ink container illustrating how the fluid interconnect seal with lock-out tab of the present invention seals the fluid ports of the ink container.

FIG. 6 is a bottom plan view of an exemplary replacement ink container 12 with the fluid interconnect seal 100 of the present invention. As indicated in FIG. 6, the back portion 110 of the interconnect seal is configured to cover the fluid ports 37 (shown in phantom) of the ink container. The ink container is shown with three fluid ports, as would typically exist on a three-color container; a black container would typically have a single fluid port. The interconnect seal is sized such that small misalignments of the seal to the ink container during manufacture do not result in a fluid port being left uncovered. The interconnect seal may alternately also extend to cover other ink container features in addition to the fluid ports, such as the electrical interconnects for the electrical storage device 80 discussed above, as indicated by dashed line 180.

Figure 7:
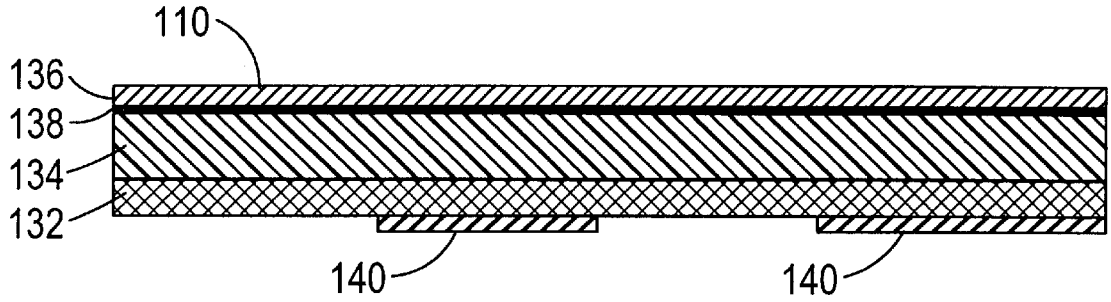
FIG. 7 is a cross sectional view of the fluid interconnect seal with lock-out tab of the present invention, showing in exaggerated form the layers comprising the seal.

FIG. 7. illustrates a cross-section of an exemplary implementation of the fluid interconnect seal of the present invention (for clarity, the thickness is greatly exaggerated). The adhesive side of the seal (which, when the seal is installed, contacts the ink container) is shown at the bottom in FIG. 7. The exemplary implementation of the interconnect seal 100 comprises a multi-layer substrate that has a removable pressure-sensitive adhesive on one surface. The seal is applied to the container over the fluid interconnect holes using standard labeling equipment and is pressed down with a pressurized roller. The multiple layers of the exemplary embodiment comprise a removable adhesive 132, a primary substrate 134, a foil layer 136, a laminating material 138, and a deadening film 140.

The adhesive 132 of the exemplary embodiment is a silicone polymer, removable system. This material provides a highly reliable seal of the fluid interconnect holes over time yet allows for clean, low-force removal at the time of use. The adhesive comprises a peroxide-catalyzed silicone pressure-sensitive adhesive (PSA) and fumed silica filler material. The adhesive layer is permanently bonded to the substrate layer, while removably adhering to the surface of the fluid container surrounding the fluid port.

The primary substrate 134 of the exemplary embodiment is PET polyester (polyethylene terephthalate) film with a thickness of approximately 0.002" (2 mils). The primary function of this layer is to provide a higher surface energy polymer surface for coating of the silicone adhesive. The higher energy surface allows for better anchorage of the adhesive to the film, essential for clean, residue-free removal of the label. The primary substrate may also be formed of other materials having suitable characteristics for bonding to the removable adhesive, and may have other thicknesses.

The foil layer 136 of the exemplary embodiment is aluminum of approximately 0.00035" (0.35 mil) thick. The primary function of this layer is to provide adequate water vapor barrier properties for the seal. A secondary function of the layer is to provide form memory to allow for the tab to be bent around the end of the supply at the latch end and remain in this angled shape. This allows for easier handling on the production line and in packaging. The foil is attached to the PET by a heat/pressure lamination process using a thin thermoset polyester layer 138.

The deadening film 140 of the exemplary embodiment is used to cover the adhesive in areas where adhesion is not necessary or desirable. The film is PET polyester (polyethylene terephthalate) of thickness 0.001" (1 mil). In the exemplary embodiment this film is applied at the tab end 120 of the label and mid-label. The application of the deadening film at mid-label reduces the risk of ink "fling" as the label is removed from the ink container and allows for easier removal by the end user.

Figure 8:
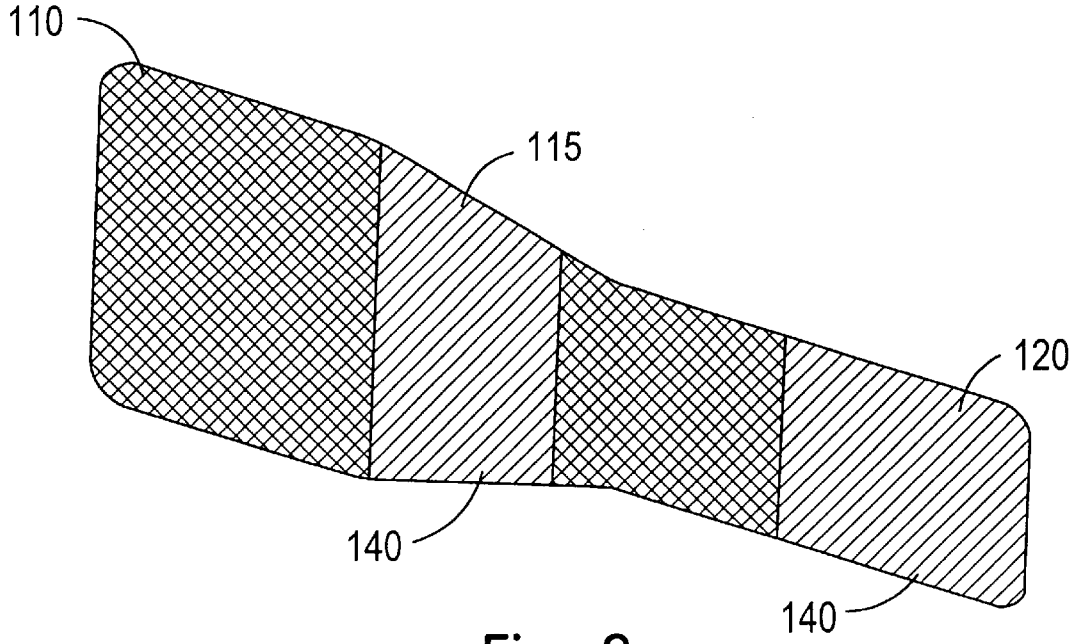
FIG. 8 is a perspective view of the fluid interconnect seal with lock-out tab of the present invention, illustration how regions of the seal are covered with a deadening film to prevent adhesion.

FIG. 8 further illustrates the side of the fluid interconnect seal which contacts the ink container. The "tab" end of the seal 120 has a layer of deadening material 140; a second area 115 of deadening material is located between the tab and the main portion of the seal which covers the fluid ports.

Figure 9A:
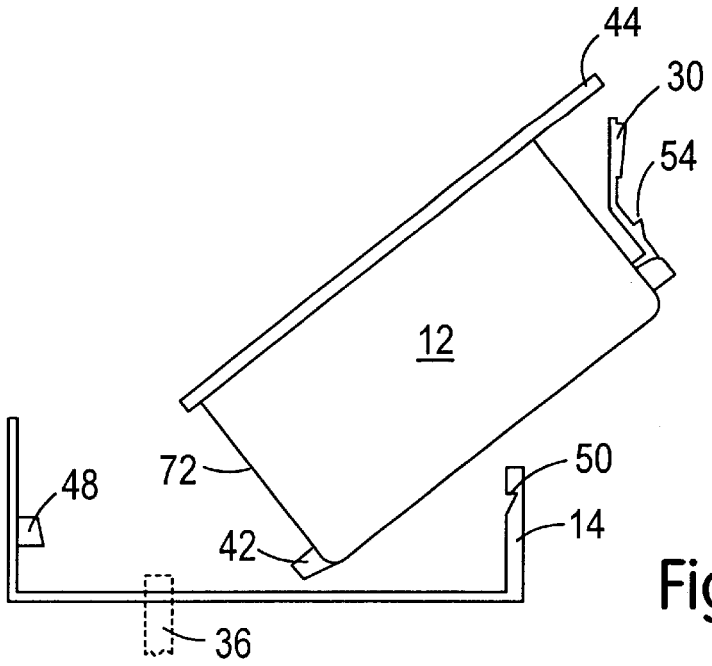
FIGS. 9*a*, 9*b*, and 9*c* are cross sectional schematic views illustrating how an exemplary ink container without the fluid interconnect seal of the present invention is installed into the receiving station of an exemplary printer system.
Figure 9B:
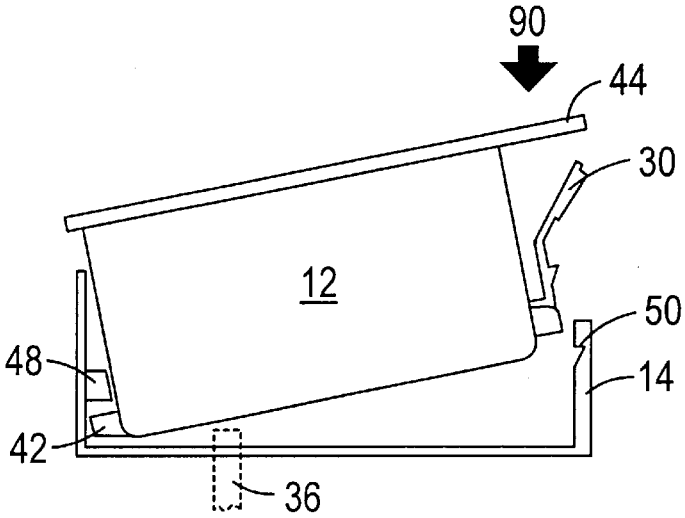
Figure 9C:
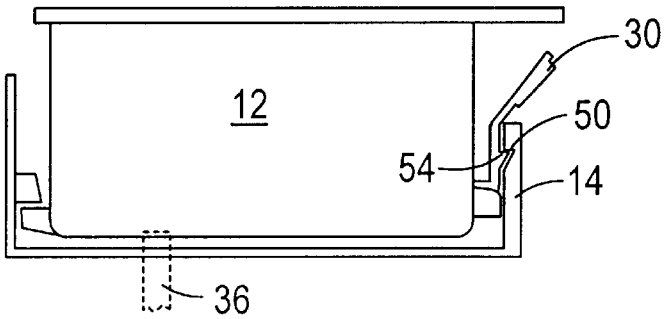

FIGS. 9*a*, 9*b*, and 9*c* are a sequence of figures which illustrate the normal insertion of a replaceable ink container 12 (after the fluid interconnect seal has been removed) into the receiving station 14 to form reliable fluidic connections with the receiving station 14.

FIG. 9*a* shows the ink container 12 partially inserted into the receiving station 14. In the preferred embodiment, the ink container 12 is inserted into the receiving station 14 by grasping the handle portion 44 and inserting the ink container into the receiving station 14 with the leading edge or leading face 72 first. Guide rails (not shown) in the receiving station and mating guide features (not shown) on the ink container facilitate installation of the container.

FIG. 9*b* shows the ink container 12 further inserted into the receiving station 14 such that the engagement feature 42 is in engagement with the engagement feature 48 associated with the receiving station 14. A downward force is applied to the ink container 12 as represented by arrows 90 to urge the trailing end 82 of the ink container 12 downwardly into the receiving station 14. One or more springs (not shown) within the receiving station provide a force resisting installation of the ink container, and also cause the container to partially eject from the receiving station when the latch members 50 and 54 are not engaged.

As the ink container 12 is urged downward into the receiving station 14, the resilient latch 30 is compressed slightly inward toward the trailing edge 82 of the ink container 12. Once the ink container 12 is urged downward sufficiently far, the engagement feature 54 on the latch 30 engages with a corresponding engagement feature 50 on the receiving station 14 to secure the ink container 12 to the receiving station 14 as shown in FIG. 9*c*. When properly installed, the one or more fluid interconnects 36 engage the fluid ports of the ink container.

Figure 10A:
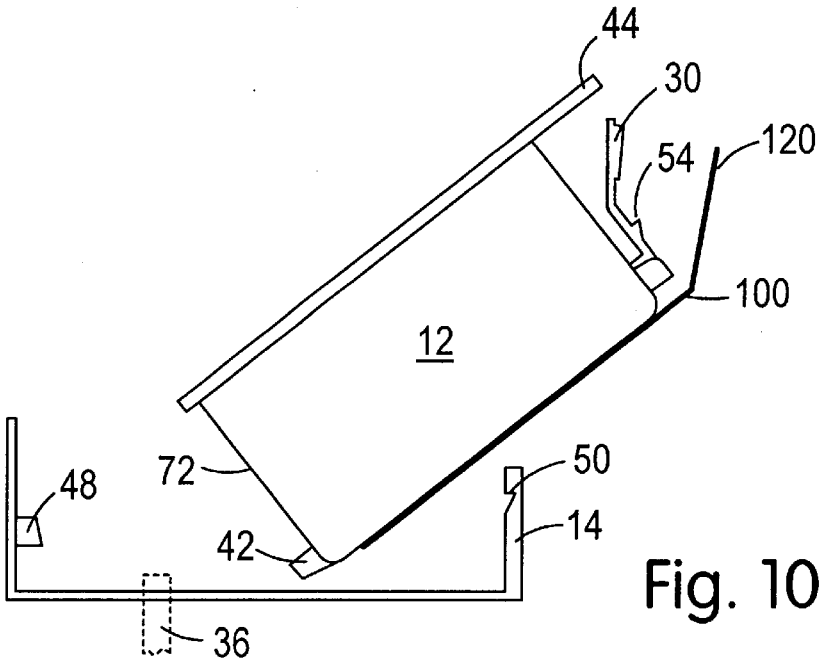
FIGS. 10*a*, 10*b*, and 10*c* are cross sectional schematic views illustrating how an exemplary ink container with the fluid interconnect seal of the present invention is prevented from being installed into the receiving station of an exemplary printer system.
Figure 10B:
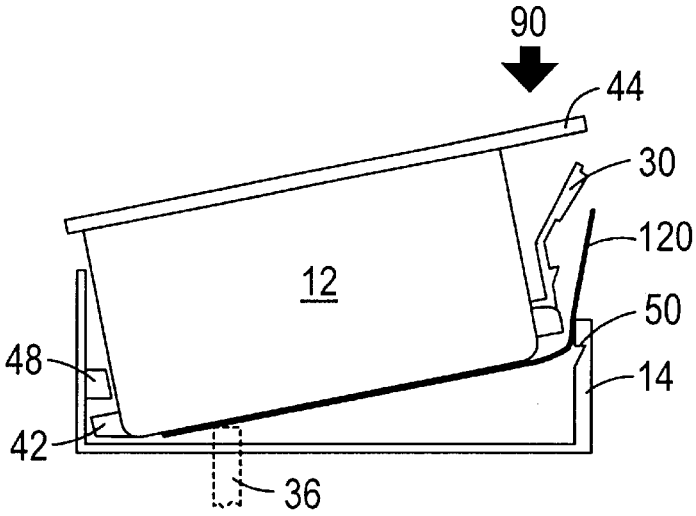
Figure 10C:
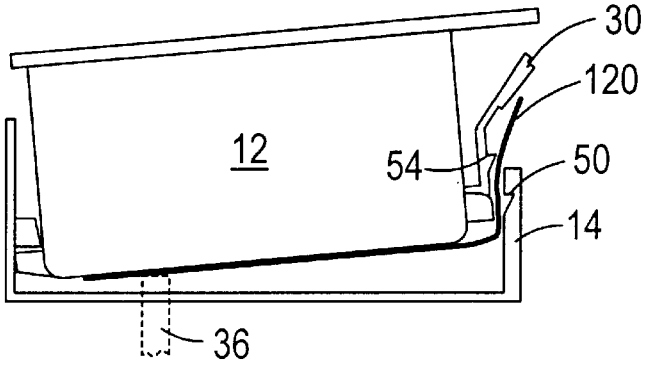

FIGS. 10*a*, 10*b*, and 10*c* illustrate a similar installation sequence to FIGS. 9*a*, 9*b*, and 9*c*, except that the fluid interconnect seal has inadvertently been left on the ink container by the installer. In FIG. 10*a*, the initial insertion of the ink container 12 into the receiving station is substantially the same as in FIG. 9*a*. As the installation continues, however, the tab portion 120 of the fluid interconnect seal begins to interfere with the installation of the container, as depicted at 10*b*. The tab physically interferes with the resilient latch 30 and the engagement feature 50 on the receiving station 14. The fluid interconnect seal is designed to be stiff and somewhat resilient, such that as the user attempts to further insert the container 12 into the receiving station 14 the tab portion 120 deforms around the resilient latch 30. The deformation of the tab provides both visual and tactile feedback the printer user to alert the user of the error condition. As depicted in FIG. 10*c*, a further attempt to force the ink container 12 into the receiving station 14 results in the tab 120 physically blocking the engagement feature 54 on the latch 30 from engaging the corresponding engagement feature 50 on the receiving station. When the user ceases to attempt to force the container 12 into the receiving station 14, the resilience of the tab portion 120, together with spring members in the receiving station (not shown), cause the container to rebound slightly out of the receiving station, again alerting the user of the error condition.

While described with respect to an exemplary ink jet container and printer system, the present invention is not limited to ink jet applications, and may be effectively utilized in other applications where it is important to prevent installation of a replaceable fluid container into the receiving station with the fluid port sealed. The seal of the present invention may also be adapted to provide physical interference with other interconnection features of the fluid container and receiving station, such as preventing connection of electrical contacts on the fluid container with electrical contacts on the receiving station, or the engagement of physical keying features.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

What is claimed is:

1. A removable fluid interconnect seal with lock-out tab for use on a fluid container having both a fluid port and an engagement latch feature to retain the container in a container receiving station, the seal comprising:

a seal portion for removably sealing said container fluid port;

a tab portion extending from the seal portion, the tab portion configured to interfere with the engagement latch feature of said fluid container when said container is placed in said container receiving station;

the seal portion and tab portion integrally formed of a multilayer substrate, the substrate having a primary substrate layer and a first surface with a removable pressure sensitive adhesive;

and wherein the pressure sensitive adhesive on the tab portion is covered by a deadening layer.

2. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a seal portion for fluidically sealing said fluid port;

a tab portion extending from the seal portion, the tab portion conflgured to interfere with the operation of said ink container latch mechanism if said ink container is placed in the printer receiving station with the fluid port seal in place;

removable adhesive on the seal portion, the sealing of said fluid port achieved by the seal removably adhering to said ink container outer surface;

and wherein the removable adhesive comprises a silicone polymer removable system.

3. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a seal portion for fluidically sealing said fluid port;

a tab portion extending from the seal portion, the tab portion configured to interfere with the operation of said ink container latch mechanism if said ink container is placed in the printer receiving station with the fluid port seal in place;

removable adhesive on the seal portion, the sealing of said fluid port achieved by the seal removably adhering to said ink container outer surface;

and wherein the primary substrate comprises a PET polyester (polyethylene terephthalate) film.

4. The removable fluid port seal of claim 3, wherein the PET polyester (polyethylene terephthalate) film has a thickness in the range of 0.001" (1 mil) to 0.005" (5 mils).

5. A removable fluid port seal for use with an ink jet printer system having at least one ink container separately replaceable from at least one printhead, the ink container having an outer surface, a fluid port extending through the outer surface, and a latch mechanism for securing the ink container in a reoeiving station of the printer, the fluid port seal comprising:

a seal portion for fluidically sealing said fluid port;

a tab portion extending from the seal portion, the tab portion configured to interfere with the operation of said ink container latch mechanism if said ink container is placed in the printer receiving station with the fluid port seal in place;

removable adhesive on the seal portion, the sealing of a fluid port achieved by the seal removably adhering to said ink container outer surface;

a water vapor barrier integral with the seal portion;

the vapor barrier comprising an aluminum foil layer;

and wherein the aluminum foil layer has a thickness in the range of 0.00010" (0.10 mil) to 0.00100" (1.00 mil).

6. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a seal portion for fluidically sealing said fluid port;

a tab portion extending from the seal portion, the tab portion configured to interfere with the operation of said ink container latch mechanism if said ink container is placed in the printer receiving station with the fluid port seal in place;

removable adhesive on the seal portion, the sealing of said fluid port achieved by the seal removably adhering to said ink container outer surface;

and wherein the seal has two sides and the adhesive forms a layer substantially covering one side, and wherein the seal further comprises a deadening layer covering the adhesive layer on the tab portion.

7. The removable fluid port seal of claim 6, wherein the deadening layer comprises PET polyester (polyethylene terephthalate).

8. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a seal portion for fluidically sealing said fluid port;

a tab portion extending from the seal portion, the tab portion configured to interfere with the operation of said ink container latch mechanism if said ink container is placed in the printer receiving station with the fluid port seal in place;

and having graphics and text printed on the seal for indicating the proper method of removing the label and installing the ink container in said printer system.

9. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a multilayer substrate having a primary substrate layer, a vapor barrier layer bonded to a first side of the primary substrate layer, and an adhesive layer bonded to a second side of the primary substrate;

a seal portion formed of the multilayer substrate for fluidically sealing said fluid port;

a tab portion also formed of the multilayer substrate extending from the seal portion, the tab portion configured to interfere with the operation of said ink container latch mechanism if said ink container is placed in the printer receiving station with the fluid port seal in place;

and wherein the primary substrate comprises a PET polyester (polyethylene terephthalate) film.

10. The removable fluid port seal of claim 9, wherein the PET polyester (polyethylene terephthalate) film has a thickness in the range of 0.001" (1 mil) to 0.005" (5 mils).

11. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a multilayer substrate having a primary substrate layer, a vapor barrier layer bonded to a first side of the primary substrate layer, and an adhesive layer bonded to a second side of the primary substrate;

a seal portion formed of the multilayer substrate for fluidically sealing said fluid port;

a tab portion also formed of the multilayer substrate extending from the seal portion, the tab portion configured to interfere with the operation of said ink container latch mechanism if an ink container is placed in the printer receiving station with the fluid port seal in place;

and wherein the adhesive layer comprises a silicone polymer removable system.

12. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a multilayer substrate having a primary substrate layer, a vapor barrier layer bonded to a first side of the primary substrate layer, and an adhesive layer bonded to a second side of the primary substrate;

a seal portion formed of the multilayer substrate for fluidically sealing said fluid port;

a tab portion also formed of the multilayer substrate extending from the seal portion, the tab portion configured to interfere with the operation of said ink container latch mechanism if said ink container is placed in the printer receiving station with the fluid port seal in place;

the vapor barrier comprising an aluminum foil layer;

and wherein the aluminum foil layer has a thickness in the range of 0.00010" (0.10 mil) to 0.00100" (1.00 mil).

13. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a multilayer substrate having a primary substrate layer, a vapor barrier layer bonded to a first side of the primary substrate layer, and an adhesive layer bonded to a second side of the primary substrate;

a seal portion formed of the multilayer substrate for fluidically sealing said fluid port;

a tab portion also formed of the multilayer substrate extending from the seal portion, the tab portion configured to interfere with the operation of said ink container latch mechanism if said ink container is placed in the printer receiving station with the fluid port seal in place; and a deadening formed over the tab portin of the adhesive layer to eliminate thickness.

14. The removable fluid port seal of claim 13, wherein the deadening layer comprises PET polyester (polyethylene terephthalate).

15. A removable fluid port seal for use with an ink jet printer system having at least one ink container separately replaceable from at least one printhead, the ink container having an outer surface, a fluid port extending through the outer surface, and a latch mechanism for securing the ink container in a receiving station of the printer, the fluid port seal comprising:

a multilayer substrate having a primary substrate layer, a vapor barrier layer bonded to a first side of the primary substrate layer, and an adhesive layer bonded to a second side of the primary substrate;

a seal portion formed of the multilayer substrate for fluidically sealing said fluid port;

a tab portion also formed of the multilayer substrate extending from the seal portion, the tab portion configured to interfere with the operation of said ink container latch mechanism if said ink container is placed in the printer receiving station with the fluid port seal in place; and graphics and text printed on the seal for indicating the proper method of removing the label and installing the ink container in said printer system.

16. A removable fluid interconnect seal with lock-out tab for use on a fluid container, the container having (a) a fluid port, (b) an engagement latch feature to retain the container in a container receiving station, and (c) an interconnection feature for mating with a corresponding interconnection feature on said container receiving station;

the seal comprising:

(a) a seal portion for removably sealing said container fluid port;

(b) a tab portion extending from the seal portion, the tab portion configured to interfere with the engagement latch feature of said fluid container when said container is placed in said container receiving station; and (c) the seal further configured to interfere with the mating of a container interconnection feature and a corresponding receiver station feature;

the seal portion and tab portion integrally formed of a multilayer substrate, the substrate having a primary substrate layer and a first surface with a removable pressure sensitive adhesive;

and wherein the pressure sensitive adhesive on the tab portion is covered by a deadening layer.

* * * * *

UNITED STATES PATENT AND TRADEMARK OFFICE

CERTIFICATE OF CORRECTION

PATENT NO. : 6,464,339 B1
DATED : October 15, 2002
INVENTOR(S) : Ardito

It is certified that error appears in the above-identified patent and that said Letters Patent is hereby corrected as shown below:

Column 8,
Line 61, delete “conflgured” and insert therefor -- configured --.
Line 29, delete “reoceiving” and insert therefor -- receiving --.
Line 37, delete “a” and insert therefor -- said --.

Column 10,
Line 59, delete “an” and insert therefor -- said --.

Column 11,
Line 40, after “deadening”, insert -- layer --.
Line 40, delete “portin” and insert therefor -- portion --.

Signed and Sealed this

Sixteenth Day of December, 2003

JAMES E. ROGAN
*Director of the United States Patent and Trademark Office*